US008603206B2

(12) United States Patent
Cai

(10) Patent No.: US 8,603,206 B2
(45) Date of Patent: Dec. 10, 2013

(54) DURABLE COATED ABRASIVE ARTICLE

(75) Inventor: Ying Cai, Shrewsbury, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 408 days.

(21) Appl. No.: 12/981,284

(22) Filed: Dec. 29, 2010

(65) Prior Publication Data

US 2011/0162287 A1 Jul. 7, 2011

Related U.S. Application Data

(60) Provisional application No. 61/290,746, filed on Dec. 29, 2009.

(51) Int. Cl.
*B24D 3/28* (2006.01)

(52) U.S. Cl.
USPC ..... 51/298; 51/295

(58) Field of Classification Search
USPC ..... 51/295, 298; 427/386
See application file for complete search history.

(56) References Cited

U.S. PATENT DOCUMENTS

| | | | | |
|---|---|---|---|---|
| 4,927,431 | A * | 5/1990 | Buchanan et al. | 51/298 |
| 5,213,589 | A | 5/1993 | Ronning et al. | |
| 5,520,957 | A | 5/1996 | Bange et al. | |
| 5,556,437 | A * | 9/1996 | Lee et al. | 51/298 |
| 5,766,277 | A * | 6/1998 | DeVoe et al. | 51/295 |
| 6,451,076 | B1 | 9/2002 | Nevoret et al. | |
| 6,936,543 | B2 | 8/2005 | Schroeder et al. | |
| 2008/0148650 | A1 | 6/2008 | You | |
| 2008/0200589 | A1 * | 8/2008 | Hubschmid | 523/436 |
| 2008/0213489 | A1 | 9/2008 | Verghese et al. | |
| 2008/0260955 | A1 | 10/2008 | Hoyles et al. | |
| 2009/0082486 | A1 | 3/2009 | Bates et al. | |
| 2009/0260297 | A1 | 10/2009 | Seth et al. | |

FOREIGN PATENT DOCUMENTS

WO WO 2009/076069 * 6/2009

OTHER PUBLICATIONS lecular eight Poly(hexylene oxide)-Poly Thio, Yonathan S. et al. Epoxy Toughening Using Low Molecular Low Mo W (ethylene oxide) Diblock Copolymers, Macromolecules. 2006;39(21)7187-7189, Sep.

Hayes, Brian S. et al. Modification of Thermosetting Resins and Composites Through Preformed Polymer Particles: A Review. Polymer Composites, 2001;22(4):451-467, No Month.

Meng Fanliang et al. Nanostnactured Thermosetting Blends of Phenolic ThenTiosets and Poly(ethylene oxide)-block-poly(propylene oxideyblock-poly(ethyiene oxide) Triblock. Copolymer. Journal of Macromolecular Science. 2008;47:450-462, No Month.

Saint-Gobain Technology Information Services, Search Results, 4 pgs., No Date.

Saint-Gobain Technology Information Services, Search Results, 13 pgs., No Date.

(Continued)

*Primary Examiner* — Pegah Parvini

(74) *Attorney, Agent, or Firm* — Joseph P. Sullivan; Abel Law Group, LLP

(57) ABSTRACT

An abrasive article comprising abrasive grains bonded with a binder comprising a matrix polymer and an amphiphilic block copolymer dispersed in the matrix polymer. The abrasive article can be a coated abrasive article, such as an engineered abrasive article, including a backing. The binder can bind the abrasive grains to the backing.

8 Claims, 2 Drawing Sheets

(56) References Cited

OTHER PUBLICATIONS

Figure 1:
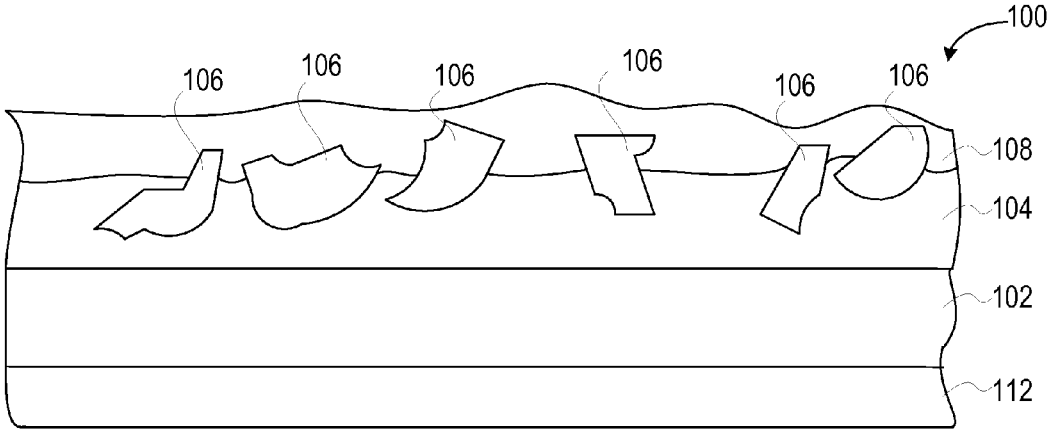

Saint-Gobain Technology Information San/ices, Search Results, 10 pgs., No Date.
"D-2794-93, Standard Test Method for Resistance of Organic Coatings to the Effects of Rapid Deformation (Impact)". ASTM International, 2004, 3 pgs., No Month.
Nanostrength, Technical Date Sheet- Nanostrength® M52 for Epoxies, Feb. 2009-Version 3, 5 pgs.
Nanostrength, Technical Date Sheet- Nanostrength® M52N for Epoxies, Feb. 2009-Version 4, 5 pgs.
Nanostrength, Technical Date heet- Nanostrength® E21 for Epoxies, Feb. 2009-Version 3, 4 pgs.
Arkema, Material Safety Data Sheet for Nanostrength® M52N NP, Apr. 14, 2009, Version 1.0. 10 pgs.
Arkema, Material Safety Data Sheet for Nanostrength® SBM E-21, Jan. 2, 2007, Revision 2.0. 6 pgs.
Arkema, Material Safety Data Sheet for Nanostrength® MAM, Jan. 2, 2007, Revision 9.0. 7 pgs.
Arkerna, "Block Copolymers and Initiators to achieve them, Carbon Nanotubes: from do-it-yourself to turn-key approaches in the design of nanostructures materials". Indo-French workshop on nanomoterials and catalysis Poitiers, May 23-25, 2007, 28 pgs.
PCT/US2010/062424, International Search Report mailed Sep. 26, 2011 (1 page).

* cited by examiner

DURABLE COATED ABRASIVE ARTICLE

CROSS-REFERENCE TO RELATED APPLICATION(S)

The present application claims priority from U.S. Provisional Patent Application No. 61/290,746, filed Dec. 29, 2009, entitled "DURABLE COATED ABRASIVE ARTICLE," naming inventor Ying Cai, which application is incorporated by reference herein in its entirety.

FIELD OF THE DISCLOSURE

This disclosure, in general, relates to coated abrasive articles and methods for forming same.

BACKGROUND

Machining using abrasive articles spans a wide industrial scope from optics industries to automotive paint repair industries, to metal fabrication industries. In each of these examples, manufacturing facilities use abrasives to remove bulk material or affect surface characteristics of products.

Surface characteristics include shine, texture, and uniformity. For example, manufacturers of metal components use abrasive articles to fine and polish surfaces, and oftentimes desire a uniform smooth surface. Similarly optics manufacturers desire abrasive articles that produce defect free surfaces to prevent light diffraction and scattering.

Manufacturers also desire abrasive articles that have a high stock removal rate for certain applications. However, there is often a trade off between removal rate and surface quality. Finer grain abrasive articles typically produce smoother surfaces, yet have a lower stock removal rate. Lower stock removal rates lead to slower production and increased cost.

The surface characteristics and material removal rate can also be affected by the durability of the abrasive article. Abrasive articles that wear easily or lose grains can exhibit both a low material removal rate and can cause surface defects. Quick wear on the abrasive article can lead to a reduction in material removal rate, resulting in frequent exchanging of the abrasive article. Further, unwanted surface defects can lead to additional polishing steps. Both frequent exchanging of abrasive articles and additional polishing steps lead to slower production and increased waste associated with discarded abrasive articles.

As such, an improved abrasive article would be desirable.

BRIEF DESCRIPTION OF DRAWING(S)

The present disclosure may be better understood, and its numerous features and advantages made apparent to those skilled in the art by referencing the accompanying drawings.

FIG. 1 includes an illustration of an exemplary coated abrasive article.

Figure 2:
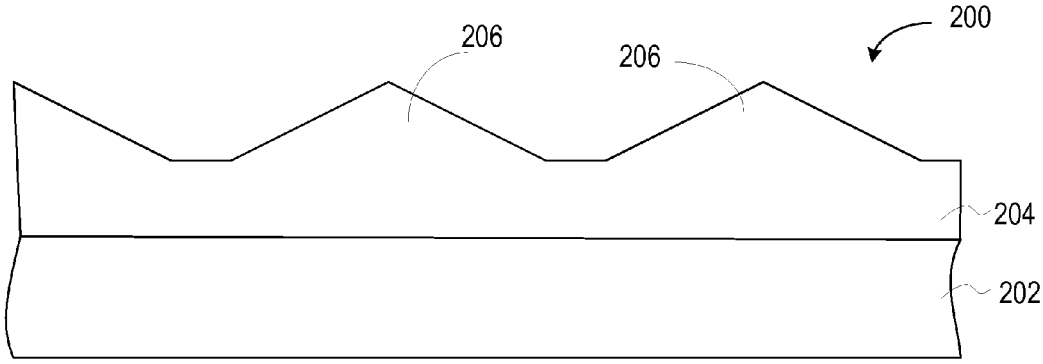

FIG. 2 includes an illustration of an exemplary structured abrasive article

Figure 3:
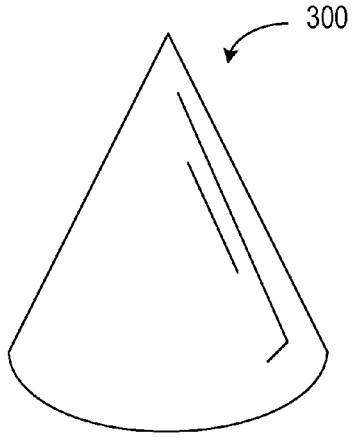

FIG. 3 includes an illustration of an exemplary bonded abrasive article.

DESCRIPTION OF THE PREFERRED EMBODIMENT(S)

In a particular embodiment, an abrasive article includes abrasive grains bound with a binder. The binder includes a matrix polymer and an amphiphilic block copolymer dispersed within the matrix polymer. A matrix polymer is a polymer that forms a matrix, a continuous phase within which other materials are embedded or dispersed. In an example, the matrix polymer includes epoxy, acrylic resin, phenolic resin, or a combination thereof. The amphiphilic block copolymer includes a polymer block that is miscible with the matrix polymer, referred to herein as a "philic block." The amphiphilic block copolymer also includes a polymer block that is immiscible with the matrix polymer, referred to herein as a "phobic block." An exemplary amphiphilic block copolymer includes a polyethylene oxide-polybutylene oxide block copolymer (PEO-PBO), a poly methyl methacrylate-polybutadiene-poly methylmethacrylate block copolymer, or a combination thereof. The abrasive article can be a coated abrasive article in which the abrasive grains are bound to a backing with the binder.

In an exemplary method, a binder formulation, including polymer precursors curable to form the matrix polymer and including an amphiphilic block copolymer, can be coated onto a backing In an example, the binder formulation can be mixed with abrasive grains to form a slurry that is coated on the backing. In another example, the binder formulation can be applied as a make coat and the abrasive grains deposited into the coating. In a further example, the binder formulation can be applied as a size coat over deposited abrasive grains or can be applied as a back coat applied on an opposite side of a backing to the abrasive grains. In an additional example, the binder formulation can be applied as a compliant layer disposed between a make coat and a backing Once coated, the binder formulation can be cured, such as through thermal curing, radiation curing, or a combination thereof.

In an example, abrasive grains are bound to a backing using a binder that includes a matrix polymer and an amphiphilic block copolymer. In an embodiment, the binder binding the abrasive grains is formed of a cured binder formulation. The binder formulation includes precursors that cure to form the matrix polymer. In addition, the binder formulation includes the amphiphilic block copolymer.

In an example, the matrix polymer is a resin selected from the group consisting of phenolic resin, urea-formaldehyde resin, acrylic resin, epoxy resin, epoxy-acrylate resin, acrylamide resin, silicone resin, isocyanurate resin, melamine-formaldehyde resin, polyimide resin, or any combination thereof. In particular, the binder formulation can include a cationically curable component, such as an epoxy component. In a further example, the binder formulation can include a free-radical curable component, such as an ethylenically unsaturated component, for example, an acrylate component or an acrylamide component.

An exemplary phenolic resin includes resole and novolac. Resole phenolic resins can be alkaline catalyzed and have a ratio of formaldehyde to phenol of greater than or equal to one, such as from 1:1 to 3:1. Novolac phenolic resins can be acid catalyzed and have a ratio of formaldehyde to phenol of less than one, such as 0.5:1 to 0.8:1.

An epoxy resin can include an aromatic epoxy or an aliphatic epoxy. Aromatic epoxies components include one or more epoxy groups and one or more aromatic rings. An example aromatic epoxy includes epoxy derived from a polyphenol, e.g., from bisphenols, such as bisphenol A (4,4'-isopropylidenediphenol), bisphenol F (bis[4-hydroxyphenyl] methane), bisphenol S (4,4'-sulfonyldiphenol), 4,4'-cyclohexylidenebisphenol, 4,4'-biphenol, 4,4'-(9-fluorenylidene) diphenol, or any combination thereof. The bisphenol can be alkoxylated (e.g., ethoxylated or propoxylated) or halogenated (e.g., brominated). Examples of bisphenol epoxies include bisphenol diglycidyl ethers, such as diglycidyl ether of Bisphenol A or Bisphenol F. A further example of an aromatic epoxy includes triphenylolmethane triglycidyl ether, 1,1,1-tris(p-hydroxyphenyl)ethane triglycidyl ether, or an aromatic epoxy derived from a monophenol, e.g., from resorcinol (for example, resorcin diglycidyl ether) or hydroquinone (for example, hydroquinone diglycidyl ether). Another example is nonylphenyl glycidyl ether. In addition, an example of an aromatic epoxy includes epoxy novolac, for example, phenol epoxy novolac and cresol epoxy novolac. Aliphatic epoxy components have one or more epoxy groups and are free of aromatic rings. The polymer precursor for the matrix polymer can include one or more aliphatic epoxies. An example of an aliphatic epoxy includes glycidyl ether of C2-C30 alkyl; 1,2 epoxy of C3-C30 alkyl; mono or multi glycidyl ether of an aliphatic alcohol or polyol such as 1,4-butanediol, neopentyl glycol, cyclohexane dimethanol, dibromo neopentyl glycol, trimethylol propane, polytetramethylene oxide, polyethylene oxide, polypropylene oxide, glycerol, and alkoxylated aliphatic alcohols; or polyols. In one embodiment, the aliphatic epoxy includes one or more cycloaliphatic ring structures. For example, the aliphatic epoxy can have one or more cyclohexene oxide structures, for example, two cyclohexene oxide structures. An example of an aliphatic epoxy comprising a ring structure includes hydrogenated bisphenol A diglycidyl ether, hydrogenated bisphenol F diglycidyl ether, hydrogenated bisphenol S diglycidyl ether, bis(4-hydroxycyclohexyl)methane diglycidyl ether, 2,2-bis(4-hydroxycyclohexyl)propane diglycidyl ether, 3,4-epoxycyclohexylmethyl-3,4-epoxycyclohexanecarboxylate, 3,4-epoxy-6-methylcyclohexylmethyl-3,4-epoxy-6-methylcyclohexanecarboxylate, di(3,4-epoxycyclohexylmethyl) hexanedioate, di(3,4-epoxy-6-methylcyclohexylmethyl)hexanedioate, ethylenebis(3,4-epoxycyclohexanecarboxylate), ethanedioldi(3,4-epoxycyclohexylmethyl)ether, or 2-(3,4-epoxycyclohexyl-5,5-spiro-3,4-epoxy)cyclohexane-1,3-dioxane.

In addition to or instead of one or more cationically curable components, the binder formulation can include one or more free radical curable components, e.g., one or more free radical polymerizable components having one or more ethylenically unsaturated groups, such as (meth)acrylate (i.e., acrylate or methacrylate) functional components.

An example of a monofunctional ethylenically unsaturated component includes acrylamide, N,N-dimethylacrylamide, (meth)acryloylmorpholine, 7-amino-3,7-dimethyloctyl (meth)acrylate, isobutoxymethyl(meth)acrylamide, isobornyloxyethyl (meth)acrylate, isobornyl (meth)acrylate, 2-ethylhexyl (meth)acrylate, ethyldiethylene glycol (meth) acrylate, t-octyl (meth)acrylamide, diacetone (meth)acrylamide, dimethylaminoethyl (meth)acrylate, diethylaminoethyl (meth)acrylate, lauryl (meth)acrylate, dicyclopentadiene (meth)acrylate, dicyclopentenyloxyethyl (meth)acrylate, dicyclopentenyl (meth)acrylate, N,N-dimethyl(meth)acrylamidetetrachlorophenyl (meth)acrylate, 2-tetrachlorophenoxyethyl (meth)acrylate, tetrahydrofurfuryl (meth)acrylate, tetrabromophenyl (meth)acrylate, 2-tetrabromophenoxyethyl (meth)acrylate, 2-trichlorophenoxyethyl (meth)acrylate, tribromophenyl (meth)acrylate, 2-tribromophenoxyethyl (meth)acrylate, 2-hydroxyethyl (meth)acrylate, 2-hydroxypropyl (meth)acrylate, vinylcaprolactam, N-vinylpyrrolidone, phenoxyethyl (meth)acrylate, butoxyethyl (meth)acrylate, pentachlorophenyl (meth)acrylate, pentabromophenyl (meth)acrylate, polyethylene glycol mono(meth) acrylate, polypropylene glycol mono(meth)acrylate, bornyl (meth)acrylate, methyltriethylene diglycol (meth)acrylate, or any combination thereof.

An example of the polyfunctional ethylenically unsaturated component includes ethylene glycol di(meth)acrylate, dicyclopentenyl di(meth)acrylate, triethylene glycol diacrylate, tetraethylene glycol di(meth)acrylate, tricyclodecanediyldimethylene di(meth)acrylate, trimethylolpropane tri(meth)acrylate, ethoxylated trimethylolpropane tri(meth) acrylate, propoxylated trimethylolpropane tri(meth)acrylate, tripropylene glycol di(meth)acrylate, neopentyl glycol di(meth)acrylate, both-terminal (meth)acrylic acid adduct of bisphenol A diglycidyl ether, 1,4-butanediol di(meth)acrylate, 1,6-hexanediol di(meth)acrylate, polyethylene glycol di(meth)acrylate, (meth)acrylate-functional pentaerythritol derivatives (e.g., pentaerythritol tri(meth)acrylate, pentaerythritol tetra(meth)acrylate, dipentaerythritol hexa(meth) acrylate, dipentaerythritol penta(meth)acrylate, or dipentaerythritol tetra(meth)acrylate), ditrimethylolpropane tetra (meth)acrylate, ethoxylated bisphenol A di(meth)acrylate, propoxylated bisphenol A di(meth)acrylate, ethoxylated hydrogenated bisphenol A di(meth)acrylate, propoxylated-modified hydrogenated bisphenol A di(meth)acrylate, ethoxylated bisphenol F di(meth)acrylate, or any combination thereof.

In one embodiment, the binder formulation includes one or more components having at least 3 (meth)acrylate groups, for example, 3 to 6 (meth)acrylate groups or 5 to 6 (meth)acrylate groups.

A silicone resin can, for example, include polyalkylsiloxanes, such as silicone polymers formed of a precursor, such as dimethylsiloxane, diethylsiloxane, dipropylsiloxane, methylethylsiloxane, methylpropylsiloxane, or any combination thereof. In a particular embodiment, the polyalkylsiloxane includes a polydialkylsiloxane, such as polydimethylsiloxane (PDMS). In another example, the silicone polymer can include a polar silicone, such as silicone including halide functional groups, such as chlorine and fluorine, or silicone including phenyls functional groups. For example, the silicone can include trifluoropropylmethylsiloxane polymers. In another exemplary embodiment, the silicone can include polyphenyl methyl siloxane.

Depending upon the catalyzing agents and type of polymer, the binder formulation can be thermally curable or can be curable through actinic radiation, such as UV radiation, to form the binder.

The binder formulation can also include catalysts and initiators. For example, a cationic initiator can catalyze reactions between cationic polymerizable constituents. A radical initiator can activate free-radical polymerization of radically polymerizable constituents. The initiator can be activated by thermal energy or actinic radiation. For example, an initiator can include a cationic photoinitiator that catalyzes cationic polymerization reactions when exposed to actinic radiation. In another example, the initiator can include a radical photoinitiator that initiates free-radical polymerization reactions when exposed to actinic radiation. Actinic radiation includes particulate or non-particulate radiation and is intended to include electron beam radiation and electromagnetic radiation. In a particular embodiment, electromagnetic radiation includes radiation having at least one wavelength in the range of about 100 nm to about 700 nm and, in particular, wavelengths in the ultraviolet range of the electromagnetic spectrum.

Cationic photoinitiators are materials that form active species that, if exposed to actinic radiation, are capable of at least partially polymerizing epoxides or oxetanes. For example, a cationic photoinitiator can, upon exposure to actinic radiation, form cations that can initiate the reactions of cationically polymerizable components, such as epoxies or oxetanes.

An example of a cationic photoinitiator includes, for example, onium salt with anions of weak nucleophilicity. An example includes a halonium salt, an iodosyl salt or a sulfonium salt, a sulfoxonium salt, or a diazonium salt, or any combination thereof. Other examples of cationic photoinitiators include metallocene salt.

In particular examples, the binder formulation includes, relative to the total weight of the composite binder formulation, about 0.1 wt % to about 15 wt % of one or more cationic photoinitiators, for example, about 1 wt % to about 10 wt %.

The binder formulation can optionally include photoinitiators useful for photocuring free-radically polyfunctional acrylates. An example of a free radical photoinitiator includes benzophenone (e.g., benzophenone, alkyl-substituted benzophenone, or alkoxy-substituted benzophenone); benzoin (e.g., benzoin, benzoin ethers, such as benzoin methyl ether, benzoin ethyl ether, and benzoin isopropyl ether, benzoin phenyl ether, and benzoin acetate); acetophenone, such as acetophenone, 2,2-dimethoxyacetophenone, 4-(phenylthio) acetophenone, and 1,1-dichloroacetophenone; benzil ketal, such as benzil dimethyl ketal, and benzil diethyl ketal; anthraquinone, such as 2-methylanthraquinone, 2-ethylanthraquinone, 2-tertbutylanthraquinone, 1-chloroanthraquinone, and 2-amylanthraquinone; triphenylphosphine; benzoylphosphine oxides, such as, for example, 2,4,6-trimethylbenzoyldiphenylphosphine oxide; thioxanthone or xanthone; acridine derivative; phenazene derivative; quinoxaline derivative; 1-phenyl-1,2-propanedione-2-O-benzoyloxime; 1-aminophenyl ketone or 1-hydroxyphenyl ketone, such as 1-hydroxycyclohexyl phenyl ketone, phenyl (1-hydroxyisopropyl)ketone and 4-isopropylphenyl(1-hydroxyisopropyl) ketone; or a triazine compound, for example, 4'''-methyl thiophenyl-1-di(trichloromethyl)-3,5-S-triazine, S-triazine-2-(stilbene)-4,6-bistrichloromethyl, or paramethoxy styryl triazine; or any combination thereof.

An exemplary photoinitiator includes benzoin or its derivative such as α-methylbenzoin; α-phenylbenzoin; α-allylbenzoin; α-benzylbenzoin; benzoin ethers such as benzil dimethyl ketal (available, for example, under the trade designation "IRGACURE 651" from Ciba Specialty Chemicals), benzoin methyl ether, benzoin ethyl ether, benzoin n-butyl ether; acetophenone or its derivative, such as 2-hydroxy-2-methyl-1-phenyl-1-propanone (available, for example, under the trade designation "DAROCUR 1173" from Ciba Specialty Chemicals) and 1-hydroxycyclohexyl phenyl ketone (available, for example, under the trade designation "IRGACURE 184" from Ciba Specialty Chemicals); 2-methyl-1-[4-(methylthio)phenyl]-2-(4-morpholinyl)-1-propanone (available, for example, under the trade designation "IRGACURE 907" from Ciba Specialty Chemicals); 2-benzyl-2-(dimethlamino)-1-[4-(4-morpholinyl)phenyl]-1-butanone (available, for example, under the trade designation "IRGACURE 369" from Ciba Specialty Chemicals); or a blend thereof.

Another useful photoinitiator includes pivaloin ethyl ether, anisoin ethyl ether; anthraquinones, such as anthraquinone, 2-ethylanthraquinone, 1-chloroanthraquinone, 1,4-dimethylanthraquinone, 1-methoxyanthraquinone, benzanthraquinonehalomethyltriazines, and the like; benzophenone or its derivative; iodonium salt or sulfonium salt as described hereinabove; a titanium complex such as bis(η5-2,4-cyclopentadienyl)bis[2,-6-difluoro-3-(1H-pyrrolyl)phenyl)titanium (commercially available under the trade designation "CGI784DC", also from Ciba Specialty Chemicals); a halomethylnitrobenzene such as 4-bromomethylnitrobenzene and the like; or mono- or bis-acylphosphine (available, for example, from Ciba Specialty Chemicals under the trade designations "IRGACURE 1700", "IRGACURE 1800", "IRGACURE 1850", and "DAROCUR 4265"). A suitable photoinitiator can include a blend of the above mentioned species, such as α-hydroxy ketone/acrylphosphin oxide blend (available, for example, under the trade designation IRGACURE 2022 from Ciba Specialty Chemicals).

A further suitable free radical photoinitiator includes an ionic dye-counter ion compound, which is capable of absorbing actinic rays and producing free radicals, which can initiate the polymerization of the acrylates.

A photoinitiator can be present in an amount of not greater than about 20 wt %, for example, not greater than about 10 wt %, or not greater than about 5 wt %, based on the total weight of the binder formulation. For example, a photoinitiator can be present in an amount of 0.1 wt % to 20.0 wt %, such as 0.1 wt % to 5.0 wt %, or 0.1 wt % to 2.0 wt %, based on the total weight of the binder formulation, although amounts outside of these ranges can also be useful. In one example, the photoinitiator is present in an amount of at least about 0.1 wt %, such as at least about 1.0 wt % or in an amount of 1.0 wt % to 10.0 wt %.

The binder formulation can also include other components such as solvents, plasticizers, crosslinkers, chain transfer agents, stabilizers, dispersants, curing agents, reaction mediators and agents for influencing the fluidity of the dispersion. For example, the binder formulation can also include one or more chain transfer agents selected from the group consisting of polyol, polyamine, linear or branched polyglycol ether, polyester and polylactone.

For example, the binder formulation can include a component having a polyether backbone. An example of a compound having a polyether backbone includes polytetramethylenediol, a glycidylether of polytetramethylenediol, an acrylate of polytetramethylenediol, a polytetramethylenediol containing one or more polycarbonate groups, or a combination thereof. In an embodiment, the external phase includes between 5 wt % and 20 wt % of a compound having a polyether backbone.

The external phase can include one or more hydroxy-functional components. A hydroxy-functional component includes monol (a hydroxy-functional component comprising one hydroxy group) or polyol (a hydroxy-functional component comprising more than one hydroxy group).

A representative example of a hydroxy-functional component includes an alkanol, a monoalkyl ether of polyoxyalkyleneglycol, a monoalkyl ether of alkyleneglycol, alkylene and arylalkylene glycol, such as 1,2,4-butanetriol, 1,2,6-hexanetriol, 1,2,3-heptanetriol, 2,6-dimethyl-1,2,6-hexanetriol, (2R,3R)-(−)-2-benzyloxy-1,3,4-butanetriol, 1,2,3-hexanetriol, 1,2,3-butanetriol, 3-methyl-1,3,5-pentanetriol, 1,2,3-cyclohexanetriol, 1,3,5-cyclohexanetriol, 3,7,11,15-tetramethyl-1,2,3-hexadecanetriol, 2-hydroxymethyltetrahydropyran-3,4,5-triol, 2,2,4,4-tetramethyl-1,3-cyclobutanediol, 1,3-cyclopentanediol, trans-1,2-cyclooctanediol, 1,16-hexadecanediol, 3,6-dithia-1,8-octanediol, 2-butyne-1,4-diol, 1,2- or 1,3-propanediol, 1,2- or 1,4-butanediol, 1,5-pentanediol, 1,6-hexanediol, 1,7-heptanediol, 1,8-octanediol, 1,9-nonanediol, 1-phenyl-1,2-ethanediol, 1,2-cyclohexanediol, 1,5-decalindiol, 2,5-dimethyl-3-hexyne-2,5-diol, 2,2,4-trimethylpentane-1,3-diol, neopentylglycol, 2-ethyl-1,3-hexanediol, 2,7-dimethyl-3,5-octadiyne-2-7-diol, 2,3-butanediol, 1,4-cyclohexanedimethanol, polyoxyethylene or polyoxypropylene glycols or triols of molecular weights from about 200 to about 10,000, polytetramethylene glycols of varying molecular weight, poly(oxyethylene-oxybutylene) random or block copolymers, copolymers containing pendant hydroxy groups formed by hydrolysis or partial hydrolysis of vinyl acetate copolymers, polyvinylacetal resins containing pendant hydroxyl groups, hydroxy-functional (e.g., hydroxy-terminated) polyesters or hydroxy-functional (e.g., hydroxy-terminated) polylactones, aliphatic polycarbonate polyols (e.g., an aliphatic polycarbonate diol), hydroxy-functional (e.g., hydroxy-terminated) polyethers (e.g., polytetrahydrofuran polyols having a number average molecular weight in the range of 150-4000 g/mol, 150-1500 g/mol, or 150-750 g/mol), or a combination thereof. An exemplary polyol further includes aliphatic polyol, such as glycerol, trimethylolpropane, or also sugar alcohol, such as erythritol, xylitol, mannitol or sorbitol. In particular embodiments, the binder formulation includes one or more alicyclic polyols, such as 1,4-cyclohexane-dimethanol, sucrose, or 4,8-bis(hydroxymethyl) tricyclo(5,2,1,0)decane.

A suitable polyether includes, in particular, linear or branched polyglycol ether obtainable by ring-opening polymerization of cyclic ether in the presence of polyol, e.g., the aforementioned polyol; polyglycol ether, polyethylene glycol, polypropylene glycol or polytetramethylene glycol or a copolymer thereof.

Another suitable polyester includes a polyester based on polyols and aliphatic, cycloaliphatic or aromatic polyfunctional carboxylic acids (for example, dicarboxylic acids), or specifically all corresponding saturated polyesters which are liquid at temperatures of 18° C. to 300° C., typically 18° C. to 150° C.: typically succinic ester, glutaric ester, adipic ester, citric ester, phthalic ester, isophthalic ester, terephthalic ester or an ester of corresponding hydrogenation products, with the alcohol component being composed of monomeric or polymeric polyols, for example, of those of the above-mentioned kind A further polyester includes aliphatic polylactone, such as ϵ-polycaprolactone, or polycarbonate, which, for example, are obtainable by polycondensation of diol with phosgene. For the binder formulation, a polycarbonate of bisphenol A having an average molecular weight of from 500 to 100,000 can be used.

In an embodiment, the compositions can comprise, relative to the total weight of the binder formulation, not greater than about 15 wt %, such as not greater than about 10 wt %, not greater than about 6 wt %, not greater than about 4 wt %, not greater than about 2 wt %, or about 0 wt % of a hydroxy-functional component. In one example, the binder formulations are free of substantial amounts of a hydroxy-functional component.

An example of a hydroxy or an amine functional organic compound for making condensation product with an alkylene oxide includes a polyol having 3 to 20 carbon atoms, a (C8-C18) fatty acid (C1-C8) alkanol amides like fatty acid ethanol amides, a fatty alcohol, an alkylphenol or a diamine having 2 to 5 carbon atoms. Such compounds are reacted with alkylene oxide, such as ethylene oxide, propylene oxide or mixtures thereof. The reaction can take place in a molar ratio of hydroxy or amine containing organic compound to alkyleneoxide of, for example, 1:2 to 1:65. The condensation product typically has a weight average molecular weight of about 500 to about 10,000, and can be branched, cyclic, linear, and either a homopolymer, a copolymer, or a terpolymer.

The binder formulation can further include a dispersant for interacting with and modifying the surface of the particulate filler. For example, a dispersant can include organosiloxane, functionalized organisiloxane, alkyl-substituted pyrrolidone, polyoxyalkylene ether, ethyleneoxide propyleneoxide copolymer, or a combination thereof. For various particulate fillers and, in particular, for silica filler, a suitable surface modifier includes siloxane.

An example of a suitable anionic dispersant includes (C8-C16) alkylbenzene sulfonate, (C8-C16) alkane sulfonate, (C8-C18) α-olefin sulfonate, α-sulfo (C8-C16) fatty acid methyl ester, (C8-C16) fatty alcohol sulfate, mono- or dialkyl sulfosuccinate with each alkyl independently being a (C8-C16) alkyl group, alkyl ether sulfate, a (C8-C16) salt of carboxylic acid or isothionate having a fatty chain of about 8 to about 18 carbons, for example, sodium diethylhexyl sulfosuccinate, sodium methyl benzene sulfonate, or sodium bis (2-ethylhexyl) sulfosuccinate (for example, Aerosol OT or AOT).

The amount of dispersant ranges from 0 wt % to 5 wt %. More typically, the amount of dispersant is between 0.1 wt % and 2 wt %. The silanes are typically used in concentrations from 40 mol % to 200 mol % and, particularly, 60 mol % to 150 mol % relative to the molecular quantity surface active sites on the surface of the nano-sized particulate filler. Generally, the binder formulation includes not greater than about 5 wt % dispersant, such as about 0.1 wt % to about 5.0 wt % dispersant, based on the total weight of the binder formulation.

In addition to the matrix polymer, the binder formulation further includes amphiphilic block copolymer. The amphiphilic block copolymer includes at least one block miscible with the matrix polymer and at least one block that is immiscible with the matrix polymer. A "philic block" is a block that is miscible with the matrix polymer, and a "phobic block" is a block that is immiscible with the matrix polymer. The nature of a philic block and a phobic block varies with the nature of the matrix polymer. For example, depending on the nature of the matrix polymer, a philic block can include polyethylene oxide, polypropylene oxide, poly(ethylene oxide-co-polypropylene oxide), poly(ethylene oxide-ran-polypropylene oxide), polymethylmethacrylate (PMMA), polyacrylamide, or a combination thereof. An exemplary phobic block can include a polyalkyl oxide having an alkyl number (the number of carbons in the alkyl chain) of at least 4, such as at least 5, or even at least 6. In an example, the alkyl number can be between 4 and 20. For example, the phobic block can include polybutylene oxide, polyhexylene oxide, polydodecylene oxide, or any combination thereof. In a further example, the phobic block can include a silicone polymer such as polydimethyl siloxane, a polymer formed from a linear or branch chain alkene monomer such as a polyolefin, styrenic blocks, polyethyl hexyl methacrylate, or any combination thereof. An exemplary polyolefin block includes polyethylene, polypropylene, ethylene propylene copolymer, ethylene butene copolymer, ethylene octene copolymer, polyisoprene, or any combination thereof. Such philic blocks and phobic blocks are particularly suitable for use with systems that include matrix polymers of epoxy resin, acrylate resin, or a combination thereof.

As such, an exemplary amphiphilic block copolymer can include poly(ethylene oxide-b-butylene oxide) block copolymer (PEO-PBO), poly(ethylene oxide-b-hexylene oxide) block copolymer (PEO-PHO), poly(methyl methacrylate-b-isoprene block copolymer (PMMA-PI), poly(methylmethacylate-b-styrene) block copolymer (PMMA-PS), polyacrylamide modified PMMA-polyisoprene block copolymer, poly(ethylene propylene-b-ethylene oxide) block copolymer (PEP-PEO), poly(butadiene-b-ethylene oxide) block copolymer (PB-PEO), poly(isoprene-b-ethylene oxide) block copolymer (PI-PEO), poly(butadiene-co-styrene-b-PMMA), a block copolymer of polysiloxane and acrylic polymer, a block copolymer of polybutylacrylate and PMMA, block terpolymers thereof, such as a poly methyl methacrylate-polybutadiene-poly methylmethacrylate block copolymer (PMMA-PB-PMMA), or any combination thereof.

In particular, the philic block can include a number of monomeric units in a range of 15 to 85. The phobic block can include a number of monomeric units in a range of 15 to 85. In an example, the philic block includes a greater number of monomeric units that the phobic block. For example, the philic block can have an average molecular weight of 750 to 100,000. The phobic block can have an average molecular weight in a range of 1,000 to 30,000.

In particular, the amphiphilic block copolymer is mixed with the matrix polymer precursors prior to curing. As such, the amphiphilic block copolymers are dispersed within the binder formulation. Once cured, the amphiphilic block copolymer forms domains in which the phobic block polymer is surrounded by philic blocks, which are in direct contact with matrix polymer. Such domains can be spherical in nature or can be elongated tube-like structures. In either case, the characteristics diameter, defined as the diameter of a cross-section of the amphiphilic block copolymer domain can be not greater than 100 nanometers. For example, the diameter of the domain can be in a range of 10 nanometers to 50 nanometers.

Further, the amphiphilic block copolymer can be included in the binder formulation in amounts in a range of 0.5 wt % to 10 wt % based on the weight of the matrix polymer. For example, the binder formulation can include the amphiphilic block copolymer in an amount in a range of 1.0 wt % to 8 wt %, such as a range of 1.5 wt % to 6.5 wt % based on the weight of the matrix polymer.

The binder formulation can further include particulate filler, such as a nanoparticle filler (i.e., nano-sized particulate filler). The particulate filler can be formed of inorganic particles, such as particles of, for example, a metal (such as, for example, steel, silver, or gold) or a metal complex such as, for example, a metal oxide, a metal hydroxide, a metal sulfide, a metal halogen complex, a metal carbide, a metal phosphate, an inorganic salt (like, for example, $CaCO_3$), a ceramic, or any combination thereof. An example of a metal oxide is ZnO, CdO, $SiO_2$, $TiO_2$, $ZrO_2$, $CeO_2$, $SnO_2$, $MoO_3$, $WO_3$, $Al_2O_3$, $In_2O_3$, $La_2O_3$, $Fe_2O_3$, CuO, $Ta_2O_5$, $Sb_2O_3$, $Sb_2O_5$, or a combination thereof. A mixed oxide containing different metals can also be present. The nanoparticles can include, for example, particles selected from the group consisting of ZnO, $SiO_2$, $TiO_2$, $ZrO_2$, $SnO_2$, $Al_2O_3$, co-formed silica alumina and a mixture thereof.

Particulate filler formed via solution-based processes, such as sol-formed and sol-gel formed ceramics, are particularly well suited for use in the composite binder. Colloidal silicas in aqueous solutions are commercially available under such trade designations as "LUDOX" (E.I. DuPont de Nemours and Co., Inc. Wilmington, Del.), "NYACOL" (Nyacol Co., Ashland, Ma.) and "NALCO" (Nalco Chemical Co., Oak Brook, Ill.). Many commercially available sols are basic, being stabilized by alkali, such as sodium hydroxide, potassium hydroxide, or ammonium hydroxide. Especially well-suited are sol-formed silica and sol-formed alumina. The sols can be functionalized by reacting one or more appropriate surface-treatment agents with the inorganic oxide substrate particles in the sol.

In a particular embodiment, the particulate filler is sub-micron sized. For example, the particulate filler can be a nano-sized particulate filler, such as a particulate filler having an average particle size of about 3 nm to about 500 nm. In an exemplary embodiment, the particulate filler has an average particle size about 3 nm to about 200 nm, such as about 3 nm to about 100 nm, about 3 nm to about 50 nm, about 8 nm to about 30 nm, or about 10 nm to about 25 nm. In particular embodiments, the average particle size is not greater than about 500 nm, such as not greater than about 200 nm, less than about 100 nm, or not greater than about 50 nm. For the particulate filler, the average particle size can be defined as the particle size corresponding to the peak volume fraction in a small-angle neutron scattering (SANS) distribution curve or the particle size corresponding to 0.5 cumulative volume fraction of the SANS distribution curve.

The particulate filler can also be characterized by a narrow distribution curve having a half-width not greater than about 2.0 times the average particle size. For example, the half-width can be not greater than about 1.5 or not greater than about 1.0. The half-width of the distribution is the width of the distribution curve at half its maximum height, such as half of the particle fraction at the distribution curve peak. In a particular embodiment, the particle size distribution curve is mono-modal. In an alternative embodiment, the particle size distribution is bi-modal or has more than one peak in the particle size distribution.

In an exemplary embodiment, the binder formulation is a solution-formed nanocomposite, which is a formulation including the polymeric components and the particulate filler in which the particulate filler is formed in solution and remains in solution until it is incorporated into the binder formulation. For example, the particulate filler is prepared in an aqueous solution and mixed with the matrix polymer. An exemplary process for preparing such a suspension includes introducing an aqueous solution, such as an aqueous silica solution; polycondensing the silicate, such as to a particle size of 3 nm to 50 nm; adjusting the resulting silica sol to an alkaline pH; optionally concentrating the sol; mixing the sol with constituents of the binder formulation; and optionally removing water or other solvent constituents from the formulation. For example, an aqueous silicate solution is introduced, such as an alkali metal silicate solution (e.g., a sodium silicate or potassium silicate solution) with a concentration in the range between 20% and 50% by weight based on the weight of the solution. The silicate is polycondensed to a particle size of 3 nm to 50 nm, for example, by treating the alkali metal silicate solution with acidic ion exchangers. The resulting silica sol is adjusted to an alkaline pH (e.g., pH>8) to stabilize against further polycondensation or agglomeration of existing particles. Optionally, the sol can be concentrated, for example, by distillation, typically to $SiO_2$ concentration of about 30 to 40% by weight. The sol is mixed with constituents of the binder formulation. Thereafter, water or other solvent constituents are removed from the suspension. In a particular embodiment, the suspension is substantially water-free.

In a particular embodiment, the binder formulation includes about 10 wt % to about 90 wt % cationically polymerizable compound, not greater than about 40 wt % radically polymerizable compound, about 0.5 wt % to 10 wt % amphiphilic block copolymer, and optionally about 5 wt % to about 80 wt % particulate filler, based on the total weight of the binder formulation. It is understood that the sum of the amounts of the binder formulation components adds to 100 wt % and, as such, when amounts of one or more components are specified, the amounts of other components correspond so that the sum of the amounts is not greater than 100 wt %.

The binder formulation can be cured to bind abrasive grains into an abrasive article. The abrasive grains can be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery, agglomerates thereof, or any combination thereof. For example, the abrasive grains can be selected from a group consisting of silica, alumina, zirconia, silicon carbide, silicon nitride, boron nitride, garnet, diamond, cofused alumina zirconia, ceria, titanium diboride, boron carbide, flint, emery, alumina nitride, or a blend thereof. Particular embodiments have been created by use of dense abrasive grains comprised principally of alpha-alumina. In addition, the abrasive grains can include agglomerates of particles of one or more of the above abrasive materials.

The abrasive grains can also have a particular shape. An example of such a shape includes a rod, a triangle, a pyramid, a cone, a solid sphere, a hollow sphere or the like. Alternatively, the abrasive grain can be randomly shaped.

The abrasive grains generally have an average grain size not greater than 2000 microns, such as not greater than about 1500 microns. In another example, the abrasive grain size is not greater than about 750 microns, such as not greater than about 350 microns. For example, the abrasive grain size can be at least 0.1 microns, such as from about 0.1 microns to about 1500 microns, and more typically from about 0.1 microns to about 200 microns or from about 1 micron to about 100 microns. The grain size of the abrasive grains is typically specified to be the longest dimension of the abrasive grain. Generally, there is a range distribution of grain sizes. In some instances, the grain size distribution is tightly controlled.

In a blended abrasive slurry including the abrasive grains and the binder formulation, the abrasive grains provide from about 10% to about 90%, such as from about 30% to about 80%, of the weight of the abrasive slurry. Alternatively, the binder formulation can be coated over a surface and the abrasive grains can be deposited The binder formulation including the amphiphilic block copolymer can be used in a slurry based process or can be used as a coating. For example, abrasive grains can be mixed with a binder formulation including the amphiphilic block copolymer to form a slurry. Such a slurry can be deposited over a backing, such as a film backing or a woven material. The binder formulation can then be cured such as through thermal curing or through exposure to actinic radiation, depending upon the nature of the matrix polymer and its initiators or catalysts.

In another exemplary embodiment, the binder formulation including the amphiphilic block copolymer can be coated on a backing and subsequently, abrasive grains can be deposited or projected into the coating. For example, a binder formulation can be coated on a backing and prior to curing the binder formulation, abrasive grains can be electrostaticly deposited onto the binder formulation. The binder formulation can be cured, such as through thermal curing or actinic radiation, depending on the nature of the matrix polymer, associated catalysts, and associated initiators. Actinic radiation includes electromagnetic radiation, such as ultraviolet radiation, or particle radiation, such as e-beam radiation. In particular, the actinic radiation includes ultraviolet radiation.

In a further exemplary embodiment, the binder formulation can be used as a coating such as a back size coat, a compliant layer, a size coating, or a saturant. For example, the binder formulation can be applied to a back side of a backing. In another example, the binder formulation can be applied as a compliant layer on a front surface or abrasive side of the backing between the make coat and the backing. In a further example, the binder formulation can be coated over deposited abrasive grains to form a size coat. In a particular example, the binder formulation can be used as a saturant for a backing including a fabric. The coatings can be subsequently cured using thermal curing or by exposure to actinic radiation, depending on the nature of the block polymers and catalysts or initiators associated with the binder formulation.

FIG. 1 illustrates an exemplary embodiment of a coated abrasive article 100, which includes abrasive grains 106 secured to a backing or support member 102. Generally, the abrasive grains 106 are secured to the backing 102 by a make coat 104. The make coat 104 includes a binder, which is formed of a cured binder formulation.

The coated abrasive article 100 can further include a size coat 108 overlying the make coat 104 and the abrasive grains 106. The size coat 108 can function to further bond the abrasive grains 106 to the backing 102 and can also provide grinding aids. The size coat 108 is generally formed from a cured binder formulation that can be the same as or different from the make coat binder formulation.

The coated abrasive 100 can also, optionally, include a back coat 112. The back coat 112 functions as an anti-static layer, preventing abrasive grains from adhering to the back side of the backing 102 and preventing swarf from accumulating during sanding. In another example, the back coat 112 can provide additional strength to the backing 102 and can act to protect the backing 102 from environmental exposure. In another example, the binder formulation can also act as a compliant layer (not illustrated) disposed between the make coat 104 and the backing 102. The compliant layer can act to relieve stress between the make coat 104 and the backing 102.

The backing 102 can be flexible or rigid. The backing 102 can be made of any number of various materials including those conventionally used as backings in the manufacture of coated abrasives. An exemplary flexible backing includes a polymeric film (including primed films), such as a polyolefin film (e.g., polypropylene including biaxially oriented polypropylene), a polyester film (e.g., polyethylene terephthalate), or a polyamide film; a cellulose ester film; a metal foil; a mesh; a foam (e.g., natural sponge material or polyurethane foam); a cloth (e.g., cloth made from fibers or yams comprising polyester, nylon, silk, cotton, poly-cotton or rayon); a paper; a vulcanized paper; a vulcanized rubber; a vulcanized fiber; a nonwoven material; or any combination thereof; or treated versions thereof. A cloth backing can be woven or stitch bonded. In particular examples, the backing 102 is selected from a group consisting of paper, polymer film, cloth, cotton, poly-cotton, rayon, polyester, poly-nylon, vulcanized rubber, vulcanized fiber, metal foil, or any combination thereof. In other examples, the backing 102 includes polypropylene film or polyethylene terephthalate (PET) film.

The backing 102 can optionally have at least one of a saturant, a presize layer or a backsize layer. The purpose of these layers is typically to seal the backing 102 or to protect yarn or fibers in the backing 102. If the backing 102 is a cloth material, at least one of these layers is typically used. Optionally, the binder formulation can be used as a saturant or a presize coating.

The backing 102 can be a fibrous reinforced thermoplastic, or an endless spliceless belt. Likewise, the backing 102 can be a polymeric substrate having hooking stems projecting therefrom. Similarly, the backing 102 can be a loop fabric.

In another example, a pressure-sensitive adhesive is incorporated onto the back side of the coated abrasive article such that the resulting coated abrasive article can be secured to a pad. An exemplary pressure-sensitive adhesive includes latex crepe, rosin, acrylic polymer or copolymer including polyacrylate ester (e.g., poly(butyl acrylate)), vinyl ether (e.g., poly(vinyl n-butyl ether)), alkyd adhesive, rubber adhesive (e.g., natural rubber, synthetic rubber, and chlorinated rubber), or a mixture thereof.

Coated abrasive articles, such as the coated abrasive article 100 of FIG. 1, can be formed by coating a backing with a binder formulation or abrasive slurry. Optionally, the backing can be coated with a compliant coat or back coat prior to coating with the make coat. Typically, the binder formulation is applied to the backing to form the make coat. In one embodiment, the abrasive grains are applied with the binder formulation, wherein the abrasive grains are blended with the binder formulation to form abrasive slurry prior to application to the backing. Alternatively, the binder formulation is applied to the backing to form the make coat and the abrasive grains are applied to the make coat, such as through electrostatic and pneumatic methods. The binder formulation is cured such as through thermal methods or exposure to actinic radiation.

Optionally, a size coat is applied over the make coat and abrasive grains. The size coat can be applied prior to curing the make coat, the make coat and size coat being cured simultaneously. Alternatively, the make coat is cured prior to application of the size coat and the size coat is cured separately.

In a further example, the coated abrasive article can include a supersize coat applied over the size coat. The supersize coat can include the binder formulation. In addition or alternatively, the supersize coat can include a grinding aid or an anti-loading material. An exemplary anti-loading material includes metal silicates, silicas, metal carbonates, metal sulfates or any combination thereof. The metal silicates can include consisting of magnesium silicates, potassium aluminum silicates, aluminum silicates, calcium silicates, or any combination thereof. In one embodiment, the magnesium silicates include talc, the potassium aluminum silicates include micas, the aluminum silicates include clays, and the calcium silicates include Wollastonite. The silicas can be selected from the group consisting of fused silica, fumed silica, and precipitated amorphous silica. The metal carbonates can include calcium carbonate. The metal sulfates can include hydrous calcium sulfate or anhydrous calcium sulfate. In a further example, the anti-loading material can include a metal salt of a long chain fatty acid, such as a metal stearate, for example, sodium, calcium, zinc or magnesium stearate.

The binder formulation forming the make coat, the size coat, the compliant coat or the back coat can include a matrix polymer and an amphiphilic block copolymer. The binder formulation can include sub-micron particulate filler, such as nano-sized particulate filler having a narrow particle size distribution. In a particular embodiment, the binder formulation is cured to form the size coat. In another embodiment, the binder formulation is cured to form the make coat. Alternatively, the binder formulation can be cured to form the optional compliant coat or the optional back coat.

In an additional embodiment, the binder formulation including the amphiphilic block copolymer can find particular use in engineered abrasives that include a pattern of surface features formed over the backing using the binder formulation. An exemplary embodiment of an engineered or structured abrasive is illustrated in FIG. 2. Engineered or structured abrasives 200 are coated abrasives including shaped structures disposed on a backing. The structured abrasive includes a backing 202 and a layer 204 including abrasive grains. The backing 202 can be formed of the materials described above in relation to the backing 102 of FIG. 1.

The layer 204 is patterned to have surface structures 206. For example, a portion of the binder formulation can be formed into hemispheres, pyramids, rows, prisms, frusta thereof, or any combination thereof. In a particular example, a binder formulation and abrasive grains, such as in the form of a slurry, can be applied to a backing and a pattern can be imprinted, stamped, or pressed into the slurry.

The layer 204 can be formed as one or more coats. For example, the layer 204 can include a make coat, optionally, a size coat, and optionally, a supersize coat. The layer 204 generally includes abrasive grains and a binder. In one exemplary embodiment, the abrasive grains are blended with the binder formulation to form abrasive slurry. Alternatively, the abrasive grains are applied to the binder after the binder is coated on the backing 202. Optionally, a functional powder can be applied over the layer 204 to prevent the layer 204 from sticking to the patterning tooling. The binder can be formed from a cured binder formulation including a matrix polymer and an amphiphilic polymer. The structured abrasive article 200 can optionally include compliant and back coats (not shown). These coats can function as described above.

In a further example, binder formulations can be used to form bonded abrasive articles, such as the abrasive article 300 illustrated in FIG. 3. In a particular embodiment, the binder formulation and abrasive grains are blended to form abrasive slurry. The abrasive slurry is applied to a mold and the colloidal binder formulation is cured. The resulting abrasive article, such as article 300, includes the abrasive grains bound by the binder in a desired shape.

In a particular embodiment, the abrasive article is formed by blending amphiphilic block copolymer with polymeric precursors and other constituents. For example, an epoxy precursor is mixed with amphiphilic block copolymer to form a binder formulation. The binder formulation is applied to a substrate, such as a backing or to a mold. Abrasive grains are also applied to the substrate, either as part of a slurry including the binder formulation or separately from the binder formulation. The binder formulation is cured. For example, the binder formulation can be thermally cured. In another example, the binder formulation can be cured through exposure to radiation, such as actinic radiation.

When the nanocomposite binder forms a make coat for a coated abrasive article, the nanocomposite binder formulation can be applied to a backing and abrasive grains applied over the formulation. Alternatively, the binder formulation can be applied over the abrasive grains to form a size coat. In another example, the binder formulation and the abrasive grains can be blended and applied simultaneously to form a coating over a substrate or to fill a mold. Generally, the binder formulation can be cured using thermal energy or actinic radiation, such as ultraviolet radiation.

Embodiments of the above described binder formulation, binder, abrasive articles, and methods for forming same are particularly advantageous. For example, abrasive articles formed of binder formulations described above can exhibit low abrasive grain loss, leading to improved surface quality. For example, when fine abrasive grains, such as abrasive grains not greater than 200 microns, are used, optical quality of lenses and glossy finish on metal works are improved. In addition, certain embodiments improve abrasive article life, leading to a reduction in the cost of grind and polishing steps and, thus, reducing product costs.

In an example, the above described abrasive articles provide polished surfaces with a desirable surface characteristic. For example, the above described abrasive articles provide a desirable Rz performance, defined below in the examples. In a particular example, the binder exhibits an Rz Index not greater than about 100 micro-inches as determined by the Rz Index test described below in the Examples section. For example, the Rz Index of the binder can be not greater than about 75 micro-inches, such as not greater than about 50 micro-inches, or not greater than about 45 micro-inches. In particular, the Rz Index may be not greater than 10 micro-inches, such as not greater than 5 micro-inches.

In a further exemplary embodiment, coated abrasive articles formed of the binder formulation described above can also exhibit desirable stock removal rate. For example, Stock Removal Performance can be determined as described below in the examples. For example, the Stock Removal Performance is at least about 0.7 grams (g) as determined by the Stock Removal Performance test described below in the Examples section. For example, the Stock Removal Performance can be at least about 0.9 g, such as at least about 1.0 g, or at least about 1.1 g.

Further, coated abrasive articles formed of the above-described binder formulation including amphiphilic block copolymers exhibit desirable retention of abrasive grains. One possible explanation is a resistance to impact or cracking Crack propagation within a binder formulation can lead to a loss of abrasive grains resulting in a decreased wear rate and possible surface defects in an abraded article. Coated abrasive articles formed of the above-described binder formulation exhibit desirable impact resistance, e.g., a low Impact Imprint Index determined as described below. For example, the Impact Imprint Index of the binder formulation can be not greater than 15 mm, such as not greater than 13 mm, or even not greater than 12.5 mm.

EXAMPLES

Example 1

Binder performance can be determined based on resistance to damage resulting from impact. For example, the binder can be tested using an impact test. Binder formulations are prepared and coated on cold-rolled steel panels at 15 mil thickness with a drawdown bar. The substrate steel panels are sanded by DA sander using P320 grit NORTON A275 disks and then cleaned 3 times with isopropyl alcohol before coating with a binder formulation. The coated panels are tested at a load of 4 in-lb using a Gardner Drop Test instrument, similar to the instrument described in ASTM D 2794-93. The metal ball impacts the panel on the side without coating. After impact, the diameter of imprints on the coating caused by impact is visually inspected and measured. At least three repeats are run and average diameters are determined.

In addition, binder performance is determined by testing binder formulations in a standardized abrasive article configuration. In a particular test, the binder formulation is used as a size coat over abrasive grains and a make coat. The abrasive grains are 80 micron heat-treated semi-friable aluminum oxide from Treibacher (BFRPL) P180 grit and the make coat is formed of UV-curable acrylate. The abrasive grains and make coat overlie a polyester backing.

An abrasive tape having dimensions 1 inch by 30 inches is placed in a microfinisher test apparatus. A 2-inch diameter workpiece ring formed of nodular iron is inserted into the apparatus. During testing, the workpiece rotates about its central axis in both directions and also oscillates back and forth along the central axis. Mineral seal oil is applied to the workpiece as a coolant. A shoe formed of segmented India Stone provides back support to the abrasive tape. The microfinisher settings include the ring speed set at 2.25, oscillation speed at 4.5, and the pressure set at 95 psi.

Prior to testing the workpiece rings are preconditioned using a 100 micron film (Q151) and then washed using a non-abrasive cleaner and are air-dried. An initial measurement of the ring and ring surface is taken. The weight of the ring is measured using a Mettler Toledo XP404S balance. The surface quality is measured using a Mahr M2 perthometer. The rings are mounted into the apparatus and the abrasive tape is inserted. The rings are ground for 5 seconds in each direction and are then washed and measured.

The Rz performance and Stock Removal Performance of the binder are determined by the Rz of the ring surface and stock removed from the ring. Rz is the average maximum height of a surface. Rz Performance measures the affect of binder formulation on workpiece Rz measurements. Stock Removal Performance measures the affect of binder formulation on grinding efficiency.

A sample (Coating 2) is prepared from an acrylate resin and Nanostrength® M52N, an amphiphilic block copolymer including polymethyl methacrylate blocks and polybutadiene blocks, available from Archema. A comparative formulation (Coating 1) that is free of amphiphilic block copolymer is also prepared. Table 1 illustrates the coating formulations and associated Impact Imprint Index, Stock Removal Performance, and Rz Index.

TABLE 1

Impact Imprint Performance and Abrasive Testing of Binder Formulation

| Component | Supplier | Coating 1 Wt % | Coating 2 Wt % |
|---|---|---|---|
| Tris (2-hydroxy ethyl) isocyanurate triacrylate | Sartomer | 18.79% | 18.24% |
| Silane treated Alumina Trihydrate | Saint-Gobain | 31.94% | 31.01% |
| Trimethylolpropane triarylate | Sartomer | 43.84% | 42.56% |
| 2-hydroxy-2-methyl-1-phenyl-1-propanone | Ciba | 5.01% | 4.86% |
| Dynol 604 | Air Products | 0.12% | 0.12% |
| BYK A501 | BYK | 0.31% | 0.3% |
| Nanostrength M52N | Archema | — | 2.91% |
| Average diameter of impact imprint on coating, mm | | 17.1 ± 0.5 | 12.4 ± 0.7 |
| Stock removal Performance, g | | 0.839 ± 0.008 | 0.979 ± 0.064 |
| Surface finish, Rz Index (micro-inches) | | 4.489 ± 0.316 | 4.007 ± 0.480 |

Due to the brittleness of Coating 1, only three measurements are successfully achieved for impact testing. For other repeats, cracks generated from impact quickly propagated upon touch during diameter measurement or movement. Coating 2 is easy to handle and six measurements are achieved. The enhancement in coating toughness by adding block copolymer M52N is visually witnessed by operator.

The table illustrates the effect of M52N on the binder through impact test results and grinding performance. With 3% loading of M52N, there is 17% increase in stock removal with equal or slightly better surface finish.

Example 2

Epoxy and acrylate binder formulations are used as a size coat over a base roll with abrasive grains and a make coat. The abrasive grains are JIS 1000 white aluminum oxide from Fujimi and the make coat is formed of UV-curable resin binder. The abrasive grains and make coat overlie a 3-mil polyester backing. Present samples (Size 2) include 3% of block copolymer Fortegra 100 in the size resin. For comparison, a sample (Size 1) is coated with a size coat comprising nano-size particle fillers. The formulations are provided below in Table 2.

Nanopox A610 includes 3,4-epoxycyclohexylmethyl-3,4-epoxycyclohexane carboxylate and 40 wt % nano-size colloidal silica particulate filler. Thus, the nano filler loading of Size 1 is about 6% by weight. Fortegra 100 is a block copolymer supplied by Dow Chemical.

The samples are tested form stock removal and surface finish. Each coated abrasive article is converted into 5" diameter disks and laminated with Velcro hoop-up pad on the back. The abrasive disk is hooked onto a supporting Norton® softside back up pad with five holes. The applied weight for grinding is 8.5 lbs. The workpiece is 6"×24"×3/16" cast acrylic panels. The abrasive article/back up pad is moved 30 strokes in 30-sec cycle against the workpiece to sand the acrylic panel. A stroke is the movement of the operator's hand in a straight line back and forth motion. The cut, i.e. the amount in weight of acrylic panel workpiece removed, is measured after every 30 strokes (30-sec) for 6 cycles in total of 3 min. The weight of acrylic panel is measured by a Mettler Toledo Model #P61003-S Scale before and after each grinding cycle to calculate the cut. The surface finish Rz, i.e., the surface finish of the acrylic panel abraded, is measured after the 1st and 6th cycle. The surface finish is measured using a Mahr M2 Perthometer. Rz is the mean of the five consecutive individual roughness measurements. Five repeats are run for each example and the average data of the above is reported.

TABLE 2

Size Resin Formulation and Performance

| Component | Supplier | Size 1 Wt % | Size 2 Wt % |
|---|---|---|---|
| Nanopox A610 (resin with nano filler) | Hanse Chemie | 14.99% | — |
| 1,4-butanedial diglycidyl ether | CVC Thermoset Specialties | 20.92% | 21.63% |
| Trimethylolpropane triarylate | Sartomer | 10.65% | 11.01% |
| Dipentaerythritol pentaacrylate | Sartomer | 5.33% | 5.51% |
| 1-hydroxy cyclohexyl phenyl ketone | Chitec | 1.52% | 1.52% |
| Chivacure 1176 | Chitec | 3.8% | 3.79% |
| 3,4-epoxycyclohexylmethy1-3,4-epoxycyclohexane carboxylate | Dow Chemical | 42.79% | 53.54% |
| Fortegra 100 (block copolymer) | Dow Chemical | — | 3% |
| Stock Removal, g | | 1 | 1.08 |
| Surface finish, Rz (micro-inches) | | 46.2 | 44.27 |

As illustrated in FIG. 2, the Size 2 exhibits greater Stock Removal Performance than the Size 1 and exhibits improved Rz Index relative to the Size 1.

In a first aspect, an abrasive article includes abrasive grains bonded with a binder comprising a matrix polymer and an amphiphilic block copolymer dispersed in the matrix polymer.

In an example of the first aspect, the binder includes the amphiphilic block copolymer in an amount in a range of 0.5 wt % to 10 wt % based on the weight of the matrix polymer, such as a range of 1.0 wt % to 8 wt % based on the weight of the matrix polymer, or a range of 1.5 wt % to 6.5 wt % based on the weight of the matrix polymer.

In another example, the matrix polymer is a resin selected from the group consisting of phenolic resin, urea-formaldehyde resin, acrylic resin, epoxy resin, epoxy-acrylate resin, acrylamide resin, silicone resin, isocyanurate resin, melamine-formaldehyde resin, polyimide resin, or any combination thereof. For example, the matrix polymer can include an epoxy resin. In a further example, the matrix polymer can include an acrylic resin. In an additional example, the matrix polymer comprises a phenolic resin. In another example, the matrix polymer is formed of a thermally curable resin. In a further example, the matrix polymer is formed of a radiation curable resin.

In an additional example, the amphiphilic block copolymer includes at least a philic block segment miscible with the matrix polymer and at least a phobic block segment immiscible with the matrix polymer. For example, the philic block segment is selected from the group consisting of polyethylene oxide, polypropylene oxide, poly(ethylene oxide-co-polypropylene oxide), poly(ethylene oxide-ran-polypropylene oxide), polymethylmethacrylate (PMMA), polyacrylamide, or any combination thereof. In another example, the phobic block segment includes a polyalkyl oxide having an alkyl number of between 4 and 20. For example, the alkyl number is at least 4. In a further example, the phobic block segment is selected from the group consisting of polysiloxane, a polymer formed from a linear or branch chain alkene monomer, styrenic blocks, polyethyl hexyl methacrylate, or any combination thereof.

In an additional example, the amphiphilic block copolymer forms domains dispersed within the matrix polymer having a diameter not greater on 100 nm, such as a range 10 nm to 50 nm.

In a further example, the abrasive grains are selected from the group consisting of silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery, agglomerates thereof, and any combination thereof.

In another example, the abrasive article exhibits a Stock Removal Performance of at least 1.0 grams. In an additional example, the abrasive article exhibits an Impact Imprint Index of not greater than 15 mm. In a further example, the abrasive article exhibits an Rz Index of not greater than 100 micro-inches.

In a second aspect, a coated abrasive article includes a backing and abrasive grains bonded to the backing by a binder comprising a matrix polymer and an amphiphilic block copolymer dispersed in the matrix polymer.

In an example of the second aspect, the binder includes the amphiphilic block copolymer in an amount in a range of 0.5 wt % to 10 wt % based on the weight of the matrix polymer, such as a range of 1.0 wt % to 8 wt % based on the weight of the matrix polymer.

In a further example, the matrix polymer is a resin selected from the group consisting of phenolic resin, urea-formaldehyde resin, acrylic resin, epoxy resin, epoxy-acrylate resin, acrylamide resin, silicone resin, isocyanurate resin, melamine-formaldehyde resin, polyimide resin, or any combination thereof. For example, the matrix polymer is formed of a thermally curable resin. In another example, the matrix polymer is formed of a radiation curable resin.

In an additional example, the amphiphilic block copolymer includes at least a philic block segment miscible with the matrix polymer and at least a phobic block segment immiscible with the matrix polymer. For example, the philic block segment is selected from the group consisting of polyethylene oxide, polypropylene oxide, poly(ethylene oxide-co-polypropylene oxide), poly(ethylene oxide-ran-polypropylene oxide), polymethylmethacrylate (PMMA), polyacrylamide, or any combination thereof. In a further example, the phobic block segment comprising a polyalkyl oxide having an alkyl number of between 4 and 20. In another example, the phobic block segment is selected from the group consisting of polysiloxane, a polymer formed from a linear or branch chain alkene monomer, styrenic blocks, polyethyl hexyl methacrylate, or any combination thereof.

In another example, the amphiphilic block copolymer forms domains dispersed within the matrix polymer having a diameter not greater on 100 nm. In a further example, the coated abrasive article exhibits a Stock Removal Performance of at least 1.0 grams. In an additional example, the coated abrasive article exhibits an Impact Imprint Index of not greater than 15 mm. In another example, the coated abrasive article exhibits an Rz Index of not greater than 100 microinches.

In an additional example, the coated abrasive article further includes a supersize coat. For example, the supersize coat includes an anti-loading material. In a particular example, the anti-loading material includes a metal stearate.

In a third aspect, a method of forming an abrasive article includes dispensing a backing and coating a slurry on the backing, the slurry comprising abrasive grains and a binder formulation. The binder formulation includes a matrix polymer precursor and an amphiphilic block copolymer. The method further includes curing the matrix polymer precursor.

In an example of the third aspect, the method further includes mixing the abrasive grains and the binder formulation to form the slurry.

In another example, curing the matrix polymer precursor includes thermally curing the matrix polymer precursor. In an additional example, curing the matrix polymer precursor includes curing the matrix polymer precursor with actinic radiation.

In a fourth aspect, a method of forming an abrasive article includes dispensing a backing and coating a binder formulation on the backing. The binder formulation includes a matrix polymer precursor and an amphiphilic block copolymer. The method further includes depositing abrasive grains on the binder formulation and curing the matrix polymer precursor.

In an example of the fourth aspect, curing the matrix polymer precursor includes thermally curing the matrix polymer precursor. In another example, curing the matrix polymer precursor includes curing the matrix polymer precursor with actinic radiation. In an additional example, depositing the abrasive grains includes electrostaticly depositing the abrasive grains.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An abrasive article comprising abrasive grains bonded with a binder comprising a matrix polymer and an amphiphilic block copolymer dispersed in the matrix polymer, wherein the matrix polymer is a resin selected from the group consisting of phenolic resin, urea-formaldehyde resin, acrylic resin, epoxy resin, epoxy-acrylate resin, acrylamide resin, silicone resin, isocyanurate resin, melamine-formaldehyde resin, polyimide resin, or any combination thereof, wherein the amphiphilic block copolymer includes at least a philic block segment miscible with the matrix polymer and at least a phobic block segment immiscible with the matrix polymer, and wherein the amphiphilic block copolymer includes a block copolymer of polybutylacrylate and polymethylmethacrylate, or block terpolymers thereof, and wherein the amphiphilic block copolymer forms domains dispersed within the matrix polymer having a diameter not greater than 100 nm.

2. The abrasive article of claim 1, wherein the binder includes the amphiphilic block copolymer in an amount in a range of 0.5 wt% to 10 wt% based on the weight of the matrix polymer.

3. The abrasive article of claim 1, wherein the abrasive article exhibits a Stock Removal Performance of at least 1.0 grams.

4. The abrasive article of claim 1, wherein the abrasive article exhibits an Impact Imprint Index of not greater than 15 mm.

5. The abrasive article of claim 1, wherein the abrasive article exhibits an Rz Index of not greater than 100 microinches.

6. The abrasive article of claim 1, further comprising a backing wherein the abrasive grains are bonded to the backing by the binder.

7. The coated abrasive article of claim 6, wherein the binder includes the amphiphilic block copolymer in an amount in a range of 0.5 wt% to 10 wt% based on the weight of the matrix polymer.

8. A method of forming an abrasive article, the method comprising:

dispensing a backing;

coating a slurry on the backing, the slurry comprising abrasive grains and a binder formulation according to claim 1; and curing the matrix polymer precursor.

* * * * *